United States Patent [19]

Hurter

[11] Patent Number: 4,463,331

[45] Date of Patent: Jul. 31, 1984

[54] ELECTROMAGNETIC RELAY

[75] Inventor: Max Hurter, Riverside, Calif.

[73] Assignee: Babcock Electro-Mechanical, Inc., Calif.

[21] Appl. No.: 376,491

[22] Filed: May 10, 1982

[51] Int. Cl.[3] ..... H01H 50/04

[52] U.S. Cl. ..... 335/202; 335/125

[58] Field of Search ..... 335/202, 125

[56] References Cited

U.S. PATENT DOCUMENTS 3,668,578 6/1972 Schroeder ..... 335/202

3,993,971 11/1976 Ono et al. ..... 335/202

*Primary Examiner*—Harold Broome

*Attorney, Agent, or Firm*—Harvey C. Nienow

[57] ABSTRACT

An electromagnetic relay which is formed with two distinct and separate compartments, one of which houses the electromagnetic motor and the other of which contains the electroresponsive armature as well as stationery and moveable contacts. Such separate compartments and their components therewithin can be manufactured separately to be subsequently joined together to make the completed relay, with any one of the electromagnetic motors being joined with any one of the armature/contact operating structures. The relay comprises permanent magnet means to increase motor efficiency and which can provide a latching function. Unique stationery contact structures are provided for receiving the motion from the moveable contact as afforded by the armature.

13 Claims, 11 Drawing Figures

FIG. 1
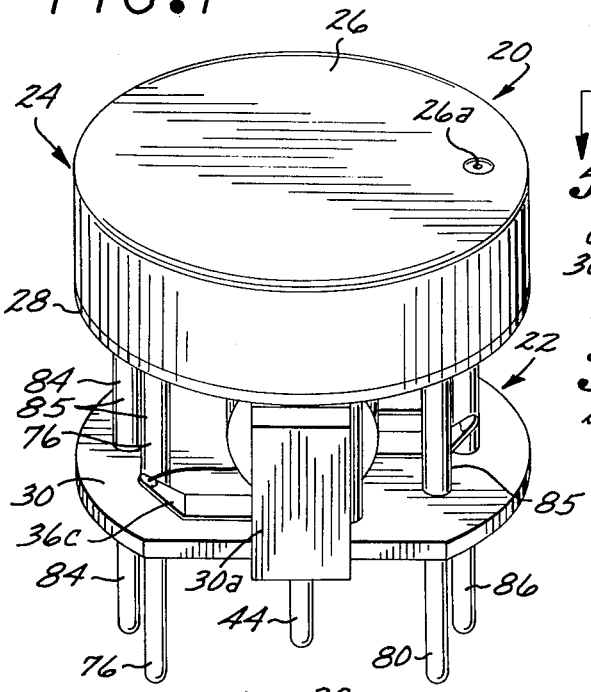
FIG. 2
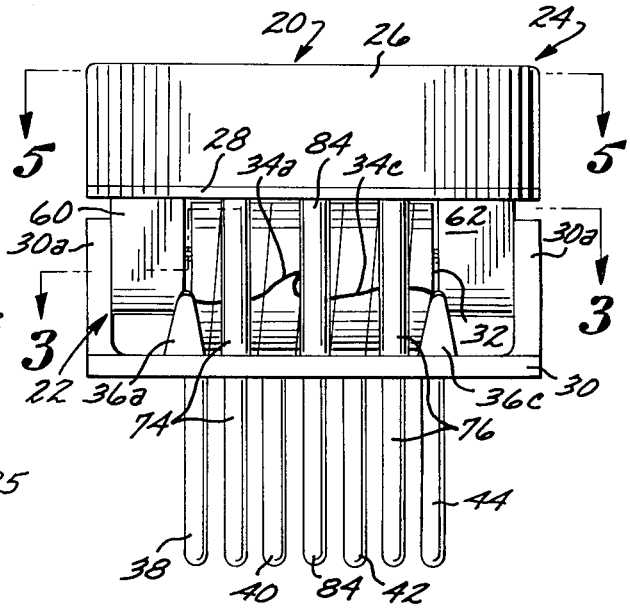
FIG. 4
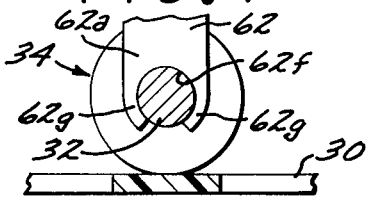
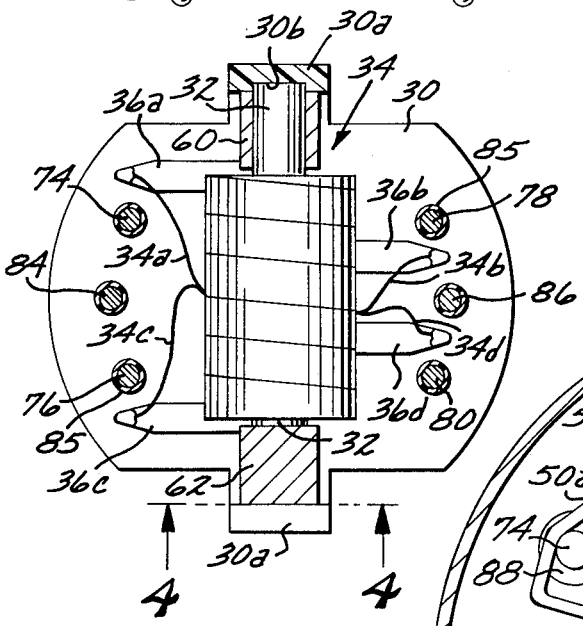
FIG. 3
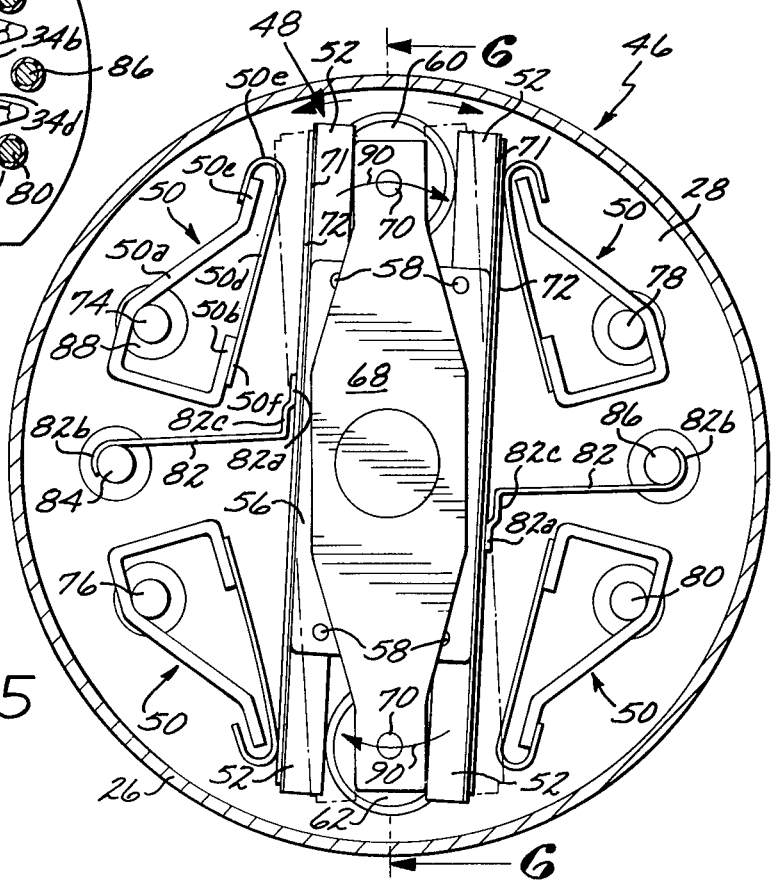
FIG. 5

ELECTROMAGNETIC RELAY

The present invention relates generally to electromagnentic relays, but more particularly to electromagnetic relays wherein the electromagnetic motor is formed in one compartment and the armature/contact structure is provided in another compartment.

Electromagnetic relays have heretofore found wide acceptance in many different industries, and today are used extensively in many unique environments. For instance, electromagnetic relays are required in space travel wherein unusually large physical shocks and high vibrations are encountered and wherein a wide range of temperatures and pressures are prevalent. As such, electromagnetic relays for such environments must be provided with unique characteristics to function satisfactorily.

Heretofore, electromagnetic relays for such unique environments have been virtually hand made, or at least have required such extensive reworking and "fine tuning" such that they have been extremely expensive to manufacture. Such prior devices also have been subject to failure, thus not only causing extremely critical malfunctions, but also have been extremely expensive to correct.

Typically, such prior art electromagnetic relays have been constructed as a single unit containing both the electromagnetic motor and the armature/contacts and thereafter such structure is placed within a hermetically sealed can. Such structure has been particularly expensive to manufacture due to the many variables as well as the interaction of such variables when both the motor and the armature/contacts are constructed in a single location. One such interaction of various components and variable parameters has been the detrimental effect of gases or vapors which emanate from the electromagnetic winding onto the electrical contacts. Such vapors have been unusually deleterious to the functioning of such contacts such that they become pitted and corroded so as to prevent electrical energy from flowing between the moveable and stationery contacts.

It is an object of the present invention to provide an electromagnetic relay which is so constructed that the gases or vapors which normally emanate from electromagnetic windings and the like do not come in contact with the electrical contacts.

It is another object of the present invention to provide an electromagnetic relay wherein the armature/contacts are housed within a given hermetically sealed compartment which is separate and apart from the electromagnetic motor including the electromagnetic winding.

A further object of the present invention is to provide an electromagnetic relay as characterized above wherein all of the electrical terminals exit or extend from the relay at one side thereof to enable the relay to be easily attached to a printed circuit board.

An even further object of the present invention is to provide an electromagnetic relay as characterized above which is capable of withstanding high shock and vibration treatment due to the use of balanced stationary contacts and a balanced armature.

An even still further object of the present invention is to provide an electromagnetic relay as characterized above wherein the moveable contacts are formed integrally with the armature so that the balanced nature of the latter minimizes the effect of high shock and vibration on the moveable contacts.

Another even still further object of the present invention is to provide an electromagnetic relay as characterized above wherein the electromagnetic motor can be formed separately and independently of the armature/contact compartment so that the several substructures can be tested and adjusted independently of each other.

Another still further object of the present invention is to provide an electromagnetic relay as characterized above wherein a partition wall which is corrosion resistant, non-magnetic, compatible with glass-to-metal sealing and weldable, separates the motor compartment from the armature/contact compartment, and through which the magnetic circuits and electrical terminals extend.

An additional object of the present invention is to provide an electromagnetic relay as characterized above which is simple and inexpensive to manufacture and which is rugged and dependable in operation.

The novel features which I consider characteristic of my invention are set forth with particularity in the appended claims. The invention itself, however, both as to its organization and mode of operation, together with additional objects and advantages thereof, will best be understood from the following description of specific embodiments when read in connection with the accompanying drawings, in which:

FIG. 1 is a perspective view of a latching relay according to the present invention, potting material being omitted for clarity;

FIG. 2 is a side elevational view of the electromagnetic relay of FIG. 1;

FIG. 3 is a sectional view of the relay of FIG. 2, taken substantially along line 3—3 thereof;

FIG. 4 is a fragmentary sectional view taken substantially along line 4—4 of FIG. 3 of the drawings;

FIG. 5 is a sectional view of the latching relay, taken substantially along line 5—5 of FIG. 2;

Like reference characters indicate corresponding parts throughout the several views of the drawings.

Figure 6:
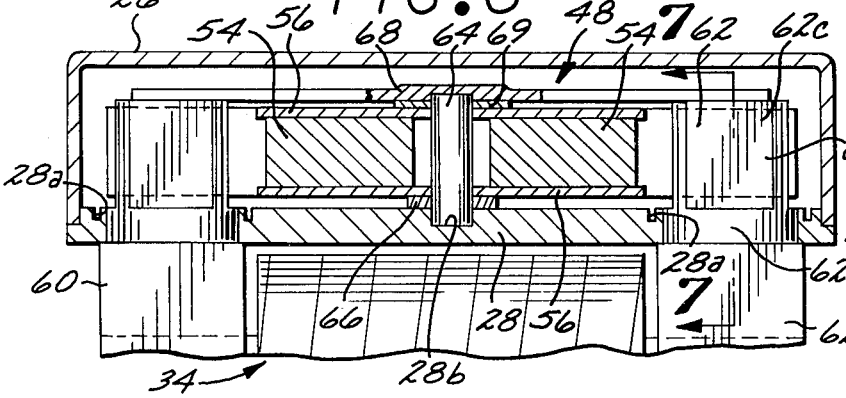
FIG. 6 is a fragmentary sectional view taken substantially along line 6—6 of FIG. 5.

The present invention is so constructed that it is simple to provide either a latching relay or a non-latching relay, as desired, with the changing of only a very minimum number of parts. In the drawings, FIGS. 1–8 inclusive, pertain to a latching relay according to the present invention and FIGS. 9–11 inclusive, are particularized to a non-latching relay according to the present invention. However, since the parts are readily interchangeable, a fact which will hereinafter be explained in greater detail, many of the figures of the drawings show parts and subassemblies which are applicable to both such relay configurations.

Referring to FIG. 1 of the drawings, there is shown therein a latching relay 20 according to the present invention. Generally, it is formed with two separated compartments, a first compartment 22 which houses the electromagnetic motor (as will hereinafter be explained) and a second compartment 24 which houses the armature/contact assembly as shown in detail in FIG. 5 of the drawings. Such second compartment 24 is shown in FIG. 1 as being enclosed within a stainless steel cover 26 which is formed with evacuation and backfill means 26*a* to enable the armature/contact compartment to be evacuated as will be readily apparent to those persons skilled in the art.

A partition wall 28 which is corrosion resistant, nonmagnetic, weldable and compatible with glass-to-metal seals, is provided between the compartments 22 and 24 and a molded plastic carrier 30 is provided at the other end of compartment 22. It has been found that stainless steel is a good material for partition wall 28.

As shown most particularly in FIGS. 1, 2 and 3 of the drawings, the carrier 30 is provided with a generally circular outer surface as well as oppositely disposed support arms 30*a*. As shown most particularly in FIG. 3, the support arms 30*a* are formed with circular recesses 30*b* for receiving and retaining a cylindrically shaped core member 32 which is formed of magnetic material such as iron and the like. Mounted on core member 32 is a winding 34 which is composed of a bobbin (not shown) whereon is wound two windings provided lead wires 34*a*, 34*b*, 34*c* and 34*d*. These several windings are the result of the bifilar wound latching coil for providing the function to be hereinafter explained in greater detail. Each such lead wire is connected to a separate conductor as shown at 36*a*, 36*b*, 36*c* and 36*d* in FIG. 3, each of the latter of which is formed integrally with a terminal pin which extends through the carrier 30 as shown at 38, 40, 42 and 44 in FIG. 8 of the drawings. Each conductor and associated terminal pin are thus a unitary structure.

Thus, the electromagnetic motor is capable of having its coils energized from external means through the terminals 38, 40, 42 and 44 as well as the conductors and lead wires associated therewith. Such energization causes magnetic flux to flow in the core member 32 for use to be hereinafter described. However, the electromagnetic motor thus far described is capable of being assembled separate and apart from the remaining portions of the electromagnetic relay such as the armature/contact assembly to be hereinafter described.

Referring to FIG. 5 of the drawings, the armature/-contact assembly 46 is mounted on the stainless steel partition wall or header 28. It comprises an armature 48 which is pivotally mounted on a pivot pin 64 which is affixed to the header or partition wall 28, for operation of stationary contacts 50.

Referring to FIGS. 5 and 6 of the drawings, the armature comprises a pair of oppositely disposed armature halves 52 which are positioned on opposite sides of a pair of rectangularly shaped permanent magnets 54 (best shown in FIG. 11 of the drawings) and a pair of oppositely disposed plates 56. As shown at 58 in FIG. 5, the armature plates 56 are welded to the armature halves 52 to firmly assemble the armature with the permanent magnets 54 contained therewithin. The armature halves are formed with recesses in their opposed surfaces to receive the permanent magnets and to retain the same in such assembled position.

Figure 7:
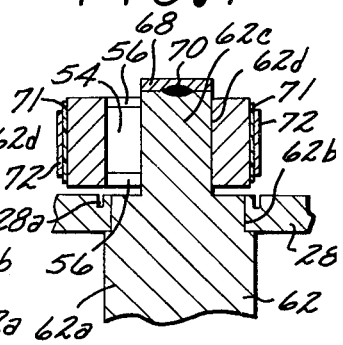
FIG. 7 is a fragmentary sectional view taken substantially along line 7—7 of FIG. 6.

As shown most particularly in FIGS. 5, 6 and 7 of the drawings, a pair of magnetic yokes 60 and 62 are provided within the stainless steel header 28. With reference to yoke 62, each such yoke is provided with a generally square cross-sectioned portion (as shown at 62*a* with respect to yoke 62), a cylindrical intermediate portion, as shown at 62*b*, and a magnetic pole portion as shown at 62*c*. The latter is formed by providing a pair of flat side pole faces as at 62*d*. As will be readily understood by those persons skilled in the art, the yoke 60 is formed identically with the yoke 62.

Each such yoke is hermetically sealed within a suitable opening formed in header 28 so as to cause the pole pieces to extend into the compartment for cooperation with the armature/contact assembly. As shown most particularly in FIGS. 5 and 6 of the drawings, the cylindrical openings in header 28 for receiving the cylindrical portion as shown at 62*b* for yoke 62, is provided with an annular groove as shown at 28*a* which enables the hermetic seal between the header and the yoke to be maintained throughout various temperature variations.

The aforedescribed armature assembly is positioned such that the bifurcated opposite ends of such armature straddle the pole pieces of the magnetic yokes 60 and 62. To accomplish this, as shown most particularly in FIG. 6 of the drawings, a pivot pin 64 is provided within a recess 28*b* in header 28. A washer or spacer 66 is interposed on the pivot pin 64 between the lower armature plate 56 and the header 28, and the upper end of the pin 64 is positioned within a suitable recess within a bridge member 68, there being a washer 69 on pin 64 between the upper armature plate 56 and the bridge member 68. As shown most particularly in FIG. 5 of the drawings, bridge member 68 is spot-welded to the upper surface of the pole pieces of the yokes, as at points 70. Thus, the armature 48 is pivotally mounted on the header 28 and is firmly secured to the pole pieces which are part of the magnetic yokes 60 and 62 and extend up through the header.

As shown most particularly in FIG. 5 of the drawings, each of the armature halves 52 is provided with a thin sheet of insulating material 71 along its outer surface, and an elongated thin moveable contact 72 is attached thereto. This enables the moveable contact 72 to be formed integrally with the armature structure 48 for movement therewith as will hereinafter be explained. The insulating materials 70, of course, electrically isolate the moveable contacts 72 from the various parts of the aforedescribed armature 48.

Each of the stationary contacts 50 is formed with a generally L-shaped rigid member 50*a* which is secured to a terminal pin at or in close proximity to the center of gravity of the assembled stationary contact 50. Such L-shaped rigid member 50*a* is formed with a pair of opposite end portions 50*b* and 50*c* which are generally parallel with each other, though offset as shown in FIG. 5.

Each stationary contact further comprises a generally J-shaped resilient member 50*d* which may be formed of a thin sheet of beryllium copper one end of which is formed with a reverse bend as shown at 50*e*. The latter end is positioned about the end portion 50*c* of rigid member 50*a* and the opposite end 50*f* of flexible member 50*d* is attached to end portion 50*b* of rigid member 50*a* as by welding, brazing, soldering and the like.

Each of the stationary contact structures 50 is attached to a separate one of terminal pins 74, 76, 78 and 80 as by welding, brazing or soldering at or near the center of gravity of the assembled stationary contact structure. This arrangement minmizes the gravitational effects on the stationary contact as might be occasioned by the occurrence of high shock forces on the entire electromagnetic relay.

Each of the aforedescribed moveable contacts 72 is connected to a terminal pin by means of a flexible conductor 82. Each such conductor is provided with an end portion 82*a* which is welded, brazed or soldered to the respective moveable contact, and the opposite end 82*b* is similarly secured to a separate one of terminal pins 84 and 86 as shown in FIG. 5. To minimize the mechanical or physical effect of conductors 82 on the action or function of the armature 48, each of such conductors is formed with an offset 82*c* which provides additional material between the respective moveable contact 72 and the terminal pin.

Each of the terminal pins 74, 76, 78, 80, 84 and 86 extends through a suitably formed opening in the partition wall or header 28, there being a glass-to-metal seal 88 provided therebetween to hermetically seal and insulate such terminal therewithin and to provide a firm, strong mechanical structure. Although such terminal pins extend through suitably formed openings in the carrier 30, as will hereinafter be explained, such assembly is not effected initially, but rather the armature/contact assemblies 46 are constructed independently of the electromagnetic motor. In fact, such armature/contact assemblies are tested separate and independently of the aforedescribed electromagnetic motors and the armature operation and function is trimmed without the electromagnetic motor in place, by altering the strength of the permanent magnets 54.

With the armature/contact assembly and the electromagnetic motor tested and adjusted separate from each other, it is a simple matter to combine the two into a unitary structure as shown most particularly in FIGS. 1 and 2 of the drawings. To facilitate this, the lower portions of the magnetic yokes 60 and 62 are formed with a generally U-shaped cutout as shown at 62*f* with respect to magnetic yoke 62 in FIG. 4 of the drawings. Such U-shaped cutout provides a pair of depending legs 62*g* which are positioned on either side of the cylindrical core member 32 when the armature/contact assembly is to be attached to the electromagnetic motor. That is, when it is desired to effectuate the combination, the terminal pins 74, 76, 78, 80, 84 and 86 are inserted through the appropriate holes in the carrier 30 until the opposite ends of the cylindrical core 32 of the electromagnetic motor are within the cutouts in the lower portion of the magnetic yokes 60 and 62. During this assembly operation, insulating sleeves 85 are placed over the six terminal pins, as shown in FIGS. 1, 2 and 3, as such pins pass through the electromagnetic motor compartment 22. With the depending legs of the magnetic yokes thus straddling the core member 32, they are swaged or upset as shown in FIG. 4 of the drawings with respect to magnetic yoke 62 to effectuate a strong mechanical connection between such yokes and the ends of core member 32. Thus, the armature/contact assembly is firmly secured to the electromagnetic motor and the magnetic circuit for such motor is completed. The electromagnetic relay 20 is thus ready to have the electromagnetic motor compartment 22 potted.

It will be noted that when the several compartments of the electromagnetic relay 20 are thus firmly interconnected, all of the terminal pins exit or extend from the plastic carrier 32 in parallel relation so as to be easily inserted into a printed circuit board or socket to make connection to all of the contacts as well as the electromagnetic coils.

The operation of the latching relay as shown in FIGS. 1–8 inclusive is such that the armature 48 pivots on pivot pin 64, as most clearly shown in FIG. 5 of the drawings. The armature 48 as shown in unbroken lines in FIG. 5 is in a first position wherein the moveable contacts 72 are engaging the flexible or resilient portion of the stationary contacts 50 which are carried by the terminal pins 76 and 78. The reversely bent portions 50*e* of such stationary contacts 50 are urged away from the end portion 50*c* of the respective rigid member 50*a* so as to cause the resiliency of member 50*d* thereof to take a strong engagement of the stationary contact with the moveable contact. Thus, with the armature in the unbroken line position shown in FIG. 5, electrical circuits connected between terminal pins 76 and 84 and electrical circuits connected between terminal pins 78 and 86 are completed through the respective stationary contacts 50, moveable contacts 72 and conductors 82.

The armature 48 is held in this position by the magnetic flux from the several permanent magnets 54. Such magnetic flux flows across the gap at the opposite ends of the armature and through the respective pole pieces of the magnetic yokes 60 and 62, generally in accordance with the curved arrows 90 as shown in FIG. 5. It is this magnetic force which remains the armature in one of its positions, due to the greater lines of force and magnetic attraction where the armature is in contact with the pole piece. Where the air gap is largest, the magnetic lines of force are minimal and therefore the armature remains in its given position while both of the several windings of the electromagnetic motor remain unenergized.

In order to reverse the position of the armature to its broken line position as shown in FIG. 5, the appropriate one of the several electromagnetic windings on core member 32 is energized through the appropriate terminal pins, conductors and lead wires. When this occurs, magnetic flux is generated in the core member 32 and flows through the magnetic yokes and armature structure so as to create a total magnetic force in the opposite direction. That is, as shown in FIG. 5, with electromagnetic flux flowing from magnetic yoke 60 therein through armature 48 to magnetic yoke 62, it is seen that such electromagnetic flux is additive to the permanent magnetic flux associated with one of the legs of the bifurcated armature end portion while it is in opposition to the permanent magnetic flux associated with the other leg of that bifurcated armature end portion. That is, as shown in FIG. 5, the electromagnetic flux leaving magnetic yoke 60 is additive to the permanent magnetic flux on the right hand leg of the bifurcated end portion of the armature and subtractive to the permanent magnetic flux at the left hand leg.

In like fashion, as such electromagnetic force traverses the armature and (see FIG. 5) leaves the armature to pass through the magnetic yoke 62 and returns to the core member 32, it is additive to the flux to the left of the pole pieces 62*c* and subtractive with the permanent magnetic flux to the right hand side thereof. Thus, the armature 48 is quickly pivoted from the unbroken line position shown in FIG. 5 to the broken line position shown therein, and it is held in such broken line position by the permanent magnetic flux when energization of the winding has been discontinued. When this occurs, of course, the moveable contacts 72 are removed from engagement with the stationary contacts 50 associated with terminal pins 76 and 78 and such moveable contacts are caused to engage the stationary contacts 50 associated with terminal pins 74 and 80, to complete circuits associated therewith. Thus, the electromagnetic relay shown in FIGS. 1–8 inclusive, is caused to be latched in its opposite direction by the permanent magnetic flux and is transferred from one position to the other by means of the electromagnetic flux. It is for that reason that several electromagnetic windings are required on core member 32 so that electromagnetic flux can be caused to flow in opposite directions, as desired, through the electromagnetic circuit as above described.

Figure 11:
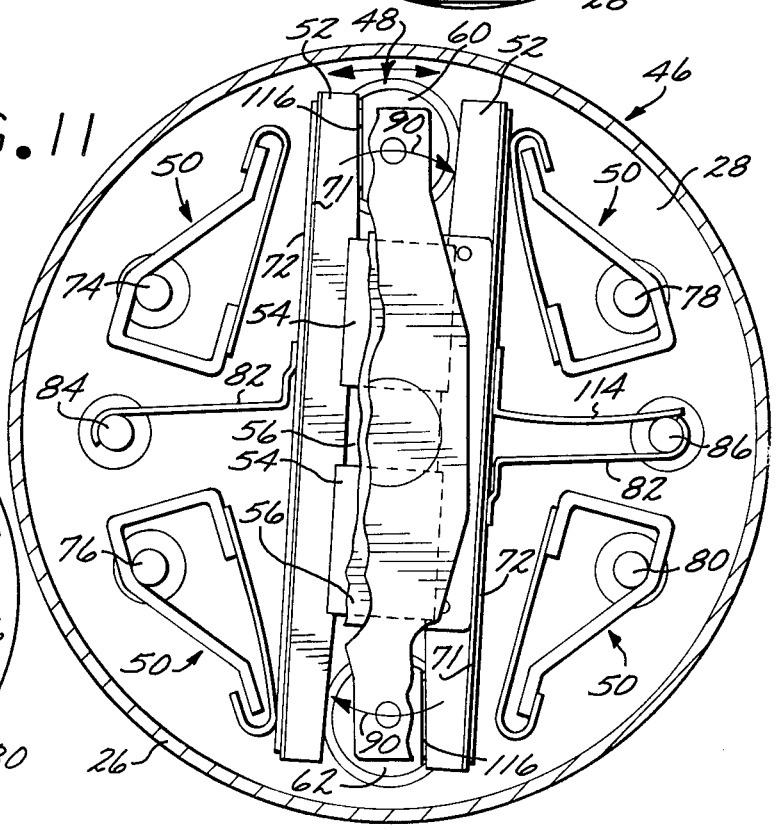
FIG. 11 is a fragmentary sectional top view of the armature/contact portion of a non-latching relay.
Figure 10:
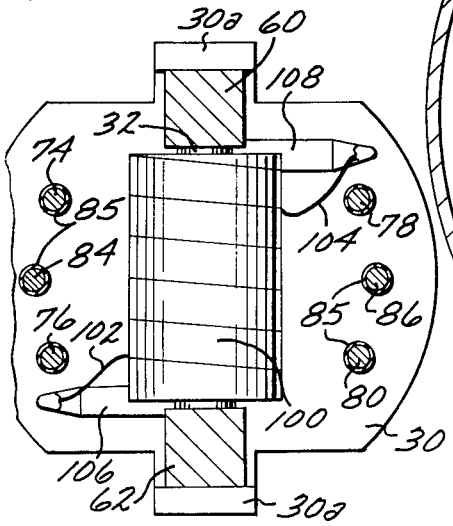
FIG. 10 is a fragmentary sectional view of the electromagnetic motor for a non-latching relay according to the present invention.

Referring to FIGS. 10 and 11, there is shown therein a two-position switch as hereinabove described with respect to the other figures of the drawings, but wherein electromagnetic flux interacting with the permanent magnetic flux is utilized to position the armature 48 in a first circuit-completing position, and a permanent magnetic flux and a mechanical return spring cooperate to position the armature 48 in a second circuit-completing position.

Figure 9:
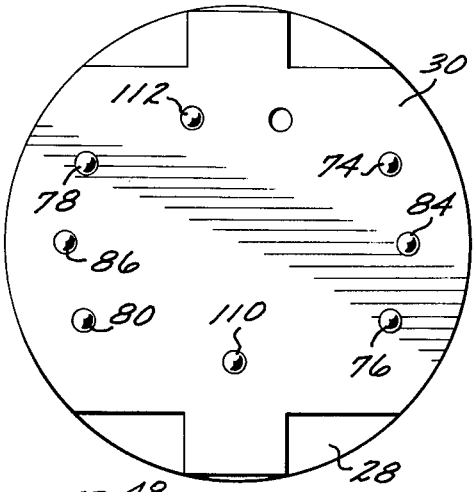
FIG. 9 is a bottom plan view of a non-latching relay according to the present invention.

For this purpose, as shown in FIG. 10 of the drawings, only a single winding or coil is employed. The lead wires 102 and 104 are connected respectively to conductors 106 and 108 which are formed integrally with terminal pins 110 and 112, respectively, as shown in FIG. 9. This arrangement affords electromagnetic flux flow in only one direction of the aforedescribed electromagnetic circuit, the return spring 114 shown in FIG. 11 being operable when the electromagnetic winding 100 is de-energized, to return the armature to its unenergized position.

As also shown in FIG. 11, thin shims 116 formed of non-magnetic material are secured to the diagonally opposite pole faces of the magnetic yokes 60 and 62 to increase the magnetic reluctance between the adjacent armature portion and the pole piece thereat. That is, with such non-magnetic shim in place, the permanent magnetic flux thereacross is minimized, decreasing appreciably the magnetic strength thereat and enabling the return spring 114 and stationary contact forces to return the armature to its non-energized position. Thereafter, when it is desired to return the pivotal armature to its opposite position against the force of return spring 114, it is merely necessary to energize winding or coil 100 so as to cause electromagnetic flux to flow from magnetic yoke 62 to magnetic yoke 60 through the armature 48 such that the permanent and electromagnetic flux across the gaps between the respective pole pieces and the armature leg with the non-magnetic shims 116 combine to rotate the armature against the force of spring 114 and into the position shown in FIG. 11. Thus, the electromagnetic relay shown in FIGS. 9, 10 and 11 is an on-off switch in accordance with energization and de-energization of winding 100.

Figure 8:
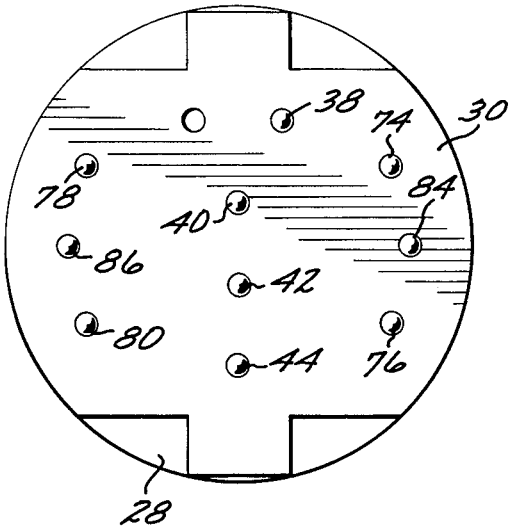
FIG. 8 is a bottom plan view of a latching relay according to the present invention.

It should be noted that terminal pin 38 for the latching relay as shown in FIG. 8 is positioned differently than is terminal pin 112 for the on-off relay. Thus, with the proper contact assembly located in the correspondingly proper carrier 30, a latching relay is prevented from being installed into a printed circuit board which has been drilled for a non-latching relay.

Although I have shown and described certain specific embodiments of my invention, I am well aware that many modifications thereof are possible. The invention, therefore, is not to be restricted insofar as is necessitated by the prior art and by the spirit of the appended claims.

I claim:

1. An electromagnetic relay comprising, in combination, means forming a housing having a wall, an armature and at least a pair of electrical contacts for operation thereby within said housing, a terminal pin for each of said electrical contacts extending through and anchored within said wall to extend externally of said housing, an electromagnetic motor comprising a winding and a core member for operation of said armature a carrier having means engaging said core member for supporting said electromagnetic motor and formed with a predetermined number of through openings, and terminal pins in circuit with said electromagnetic motor and extending through some of said through openings in said carrier, said carrier being in spaced relation to said wall to position said motor therebetween, and receiving in the other of said openings the terminal pins for said electrical contacts.

2. An electromagnetic relay according to claim 1 wherein said electromagnetic motor comprises an electroresponsive winding and a portion of a magnetic flux circuit between said carrier and said wall, the remainder of said magnetic circuit being within said housing for magnetic association with said armature.

3. An electromagnetic relay according to claim 2 wherein said magnetic circuit includes a magnetic yoke which extends through said partition wall and includes a pole piece in flux-conducting relation with said armature.

4. An electromagnetic relay according to claim 2 wherein at least one permanent magnet is mounted on said armature to provide magnetic flux for cooperation with the flux in said magnetic circuit afforded by said electroresponsive winding.

5. An electromagnetic relay according to claim 4 wherein said armature is pivotally mounted within said housing and is formed with a bifurcated moveable end portion, said permanent magnet being fixed to said armature to provide permanent magnetic flux across the gap afforded by said bifurcated end portion.

6. An electromagnetic relay according to claim 2 wherein said armature is formed with a bifurcated moveable end portion providing a gap for receiving said pole piece of said electromagnetic circuit.

7. An electromagnetic relay according to claim 6 wherein at least one permanent magnet is provided on said armature to provide permanent magnetic flux across said gap.

8. An electromagnetic relay according to claim 1 wherein the terminal pins in circuit with said electrical contacts are hermetically sealed in said partition wall.

9. An electromagnetic relay according to claim 3 wherein said yoke is hermetically sealed in said wall.

10. An electromagnetic relay according to claim 9 wherein said magnetic flux circuit associated with said winding includes an elongated core member in flux-conducting relation with said winding and a magnetic yoke at each of the opposite ends of said core, each of said yokes extending through said wall and having a pole piece in flux-conducting relation with said armature and being attached to the respective end of said core.

11. An electromagnetic relay according to claim 1 wherein said electrical contacts include at least one moveable contact and one stationary contact, the latter of which is formed with a reversely bent rigid member and a flexible member fixed to one end of said rigid member and in engagement with the other end thereof to be contacted by said moveable contact.

12. An electromagnetic relay according to claim 11 wherein said rigid member is fixed to one end of a terminal pin at approximately the center of gravity of said rigid member.

13. An electromagnetic relay according to claim 10 wherein each of the opposite ends of said core is formed with an annular surface and each of said yokes is formed with an arcuate recess for engaging the annular surface of the respective end of said core within the space between said wall and carrier.

* * * * *